US005810467A

United States Patent [19]

Hurwitz

[11] Patent Number: 5,810,467

[45] **Date of Patent: *Sep. 22, 1998**

[54] ELECTROLUMINESCENT ILLUMINATED PROTECTIVE HAT SUCH AS A HARD HAT, HELMET AND THE LIKE, AND A RETROFIT UNIT FOR RETROFITTING EXISTING PROTECTIVE HATS TO INCLUDE AN ELECTROLUMINESCENT ILLUMINATION DEVICE

[76] Inventor: Marni M. Hurwitz, 226 Mountain Side Rd., Mendham, N.J. 07945

[ * ] Notice: The term of this patent shall not extend beyond the expiration date of Pat. No. 5,327,587.

[21] Appl. No.: 418,473

[22] Filed: Apr. 7, 1995

[51] Int. Cl.[6] ..... F21L 15/14

[52] U.S. Cl. ..... 362/106; 362/84; 362/183; 2/422

[58] Field of Search ..... 362/84, 105, 106, 362/183, 191, 396, 234; 2/422, 906, 5

[56] References Cited

U.S. PATENT DOCUMENTS 4,916,594 4/1990 Headley ..... 362/183 X 5,327,587 7/1994 Hurwitz ..... 362/105 X 5,426,792 6/1995 Murasko ..... 362/105 X 5,479,325 12/1995 Chien ..... 2/422 X

*Primary Examiner*—Stephen F. Husar

*Attorney, Agent, or Firm*—Sughrue, Mion, Zinn, Macpeak & Seas, PLLC

[57] ABSTRACT

An illuminated protective hat including at least one eletroluminescent lamp secured to a shell of the protective hat, which is powered by a power unit housed in a power unit portion of the protective hat shell, where the power unit includes a rechargeable battery. A retrofit unit including at least one electroluminescent lamp and power unit portion, to retrofit existing protective hats with the electroluminescent lamp and power unit portion. Both the electroluminescent lamp and the power unit portion of the retrofit unit can be either permanently or temporarily secured to a protective hat.

49 Claims, 9 Drawing Sheets

ELECTROLUMINESCENT ILLUMINATED PROTECTIVE HAT SUCH AS A HARD HAT, HELMET AND THE LIKE, AND A RETROFIT UNIT FOR RETROFITTING EXISTING PROTECTIVE HATS TO INCLUDE AN ELECTROLUMINESCENT ILLUMINATION DEVICE

BACKGROUND OF THE INVENTION

The present invention relates to an improved illumination device, including an electroluminescent lamp, for protective head gear such as helmets, hard hats and the like, which are worn by individuals engaging in activities in areas where protective hats must be worn and where illumination is required to render the user visible in reduced light conditions or conditions with no light.

Protective hats, such as hard hats, have been heretofore equipped with a lamp, such as a halogen lamp, to provide illumination of a work area under low-light conditions. However, the lamp provides illumination only directly in front of the worker to illuminate the immediate work area in front of the worker. Therefore, the workers, themselves, are not readily visible under low-light conditions or no-light conditions.

Such visibility problems exist for policemen, construction workers, miners, disaster teams, rescue squads, forestry, oil and gas drilling crews, firemen, ground airport traffic controllers, highway workers, astronauts, railroad workers, public utility workers, logging crews under conditions of precipitation, for example. At present, some protective hats and/or clothing articles are provided with reflectors. However, the use of reflectors provides limited protection since the presence of the individual is only indicated when light impinges upon the reflectors to generate reflected light. Therefore, reflectors cannot operate independently to render an individual visible in low-light conditions. Moreover, a vehicle having a light source, which generates reflected light from the reflector (including automobiles, ground vehicles at the airports, airplanes, machinery, etc.), can get relatively close to the individual before the operator thereof is alerted to the individual's presence.

Accident and fatality statistics have proven the crucial need for workers to be made more visible.

There are over 120,000 industrial head injuries annually, which cost America over $2 billion, a great many of which are due to the fact that the individual was not visible.

There is clearly a need for an extremely thin, light-weight, flexible and durable illumination device for protective hats which emits enough light to render an individual visible under reduced lighting conditions or no-light conditions without interfering with the illumination of a work area. The illumination for electroluminescent lamps is subtle enough so as not to be disturbing to the wearer or fellow workers, while deliberately and clearly highlighting the individual for a safer working environment.

SUMMARY OF THE INVENTION

It is an object of the present invention to provide a protective hat, such as a hard hat, helmet, and the like, which overcomes the disadvantages of prior protective hats, by including a light-weight, extremely thin, heat-resistant and durable illumination device which does not emit heat.

It is a further object of the present invention to provide a protective hat including an illumination device which is battery operated and which requires a minimal amount of power.

Yet another object of the present invention is to provide a retrofit arrangement which can be used to equip a previously purchased or manufactured protective hat with the above-mentioned illuminating device.

Finally, it is an object of the present invention to provide an illuminated protective hat and retrofit unit which provides sufficient illumination to render an individual visible during low-light conditions or no-light conditions, yet does not distract fellow workers or impair the illumination of a work area.

The above-mentioned objects of the invention are accomplished by an illuminated protective hat, such as a hard hat, which includes a light-weight, extremely thin electroluminescent lamp which is battery powered, and which is secured to the shell of the protective hat, and a power unit portion integral with the protective hat for housing a power unit for supplying power to the electroluminescent lamp.

The above-mentioned objects of the invention are further accomplished by a retrofit unit which includes a battery powered electroluminescent lamp, having a predetermined shape, and a power unit, both of which can be permanently or temporarily fixed onto an existing protective hat.

DETAILED DESCRIPTION OF THE PREFERRED EMBODIMENT

The present invention will be described with reference to the accompanying drawings. In order to facilitate a description of the invention, an application directed to a hard hat, including an electroluminescent lamp in the form of a strip, is set forth hereinbelow.

Figure 1:
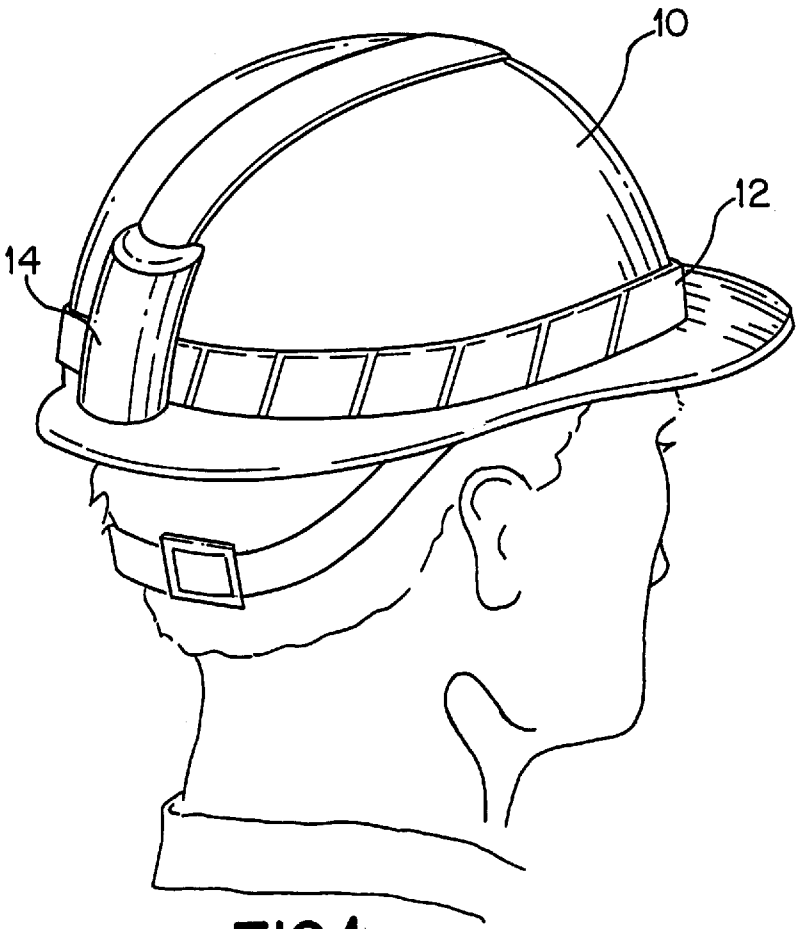
FIG. 1 is a perspective view of an illuminated protective hat according to a first embodiment of the present invention as seen from the side.

FIG. 1 illustrates the general arrangement of an illuminated hard hat 10 according to a first embodiment of the present invention. In this embodiment, the illuminated hard hat 10 includes at least one electroluminescent lamp 12, in the form of a strip, secured to the shell of the hard hat, which provides illumination, and a power unit portion 14.

The electroluminescent lamp 12 is a light-weight, flexible, shock-resistant and safe device for generating continuous or flashing illumination on the hard hat which is visible for more than a quarter of a mile.

Other beneficial characteristics of the electroluminescent lamp include low power consumption, does not attract insects, produces no noticeable heat, superior moisture resistance, and even illumination, without glare, which does not distract other workers and which does not impair the illumination of a work area.

The electroluminescent lamp is produced by embedding phosphors in a thin layer of a transparent insulator which is then placed between electrodes for conducting current. The illumination from the electroluminescent lamp is highly visible, even through fog and smoke.

The electroluminescent lamp dims only when the battery requires recharging or replacement.

Electroluminescent lamps require an AC signal. Therefore, an inverter device is used to convert the DC signal from a battery source, for example, to an AC signal. A variety of inverter devices having varying sizes are presently available. The inverter device operates as a load responsive device which, as the electroluminescent lamp ages, will increase the voltage and frequency delivered to the electroluminescent lamp.

The electroluminescent lamps according to the present invention may be any one of a number of shapes, colors and sizes.

Figure 10:
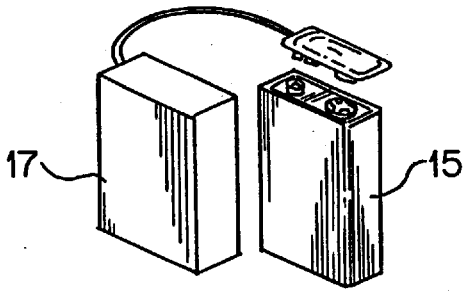
FIG. 10 is an illustration of the battery and inverter which may be included in the first and second embodiments.

The power unit portion 14 of the illuminated hard hat is an integral part of the hard hat which protrudes from the remaining portion of the hard hat shell to form a compartment for housing a battery 15 and an inverter device 17 (illustrated in FIG. 10). The inner surface of the hard hat remains intact; that is, the inside of the hard hat is a smooth surface. In the example illustrated in FIG. 1, the power unit portion 14 is arranged in the rear of the hard hat. However, different locations can likewise be used.

The hard hat according to the first embodiment may be modified to include a power unit portion which is recessed into the hard hat.

Figure 2:
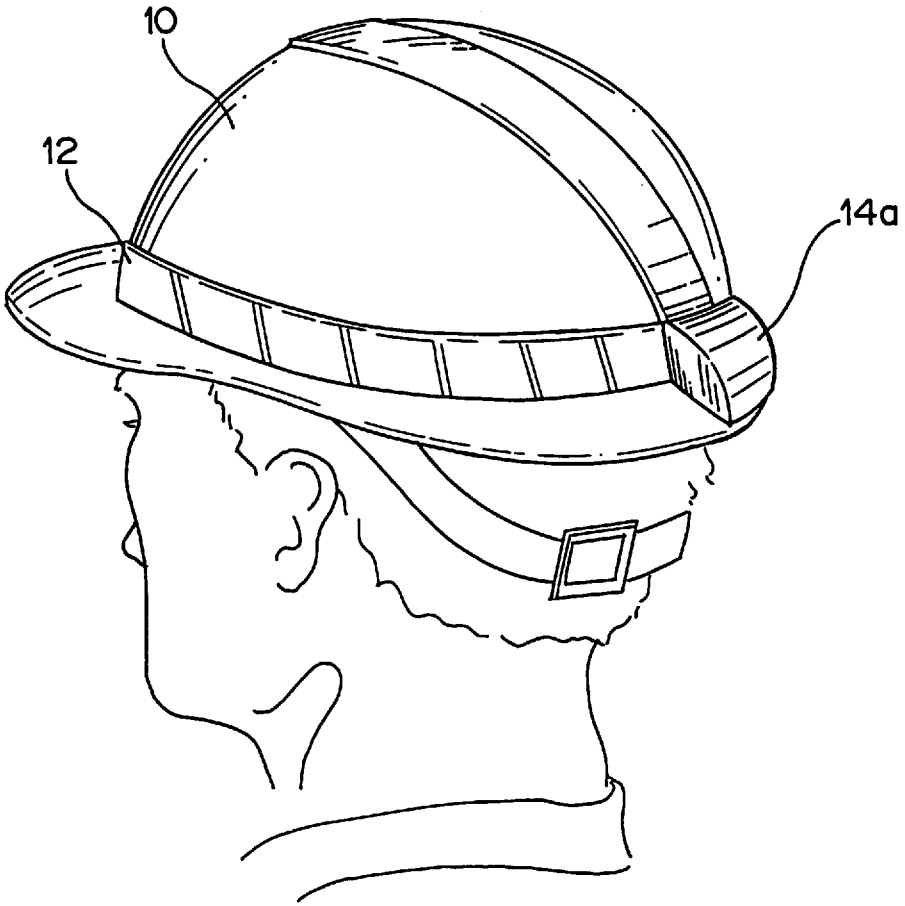
FIG. 2 illustrates a modification of the illuminated protective hat according to the first embodiment.

A further modification is illustrated in FIG. 2, where a power unit portion 14*a* is formed in the rim portion of the hard hat and protrudes from the upper surface of the rim portion.

Figure 3:
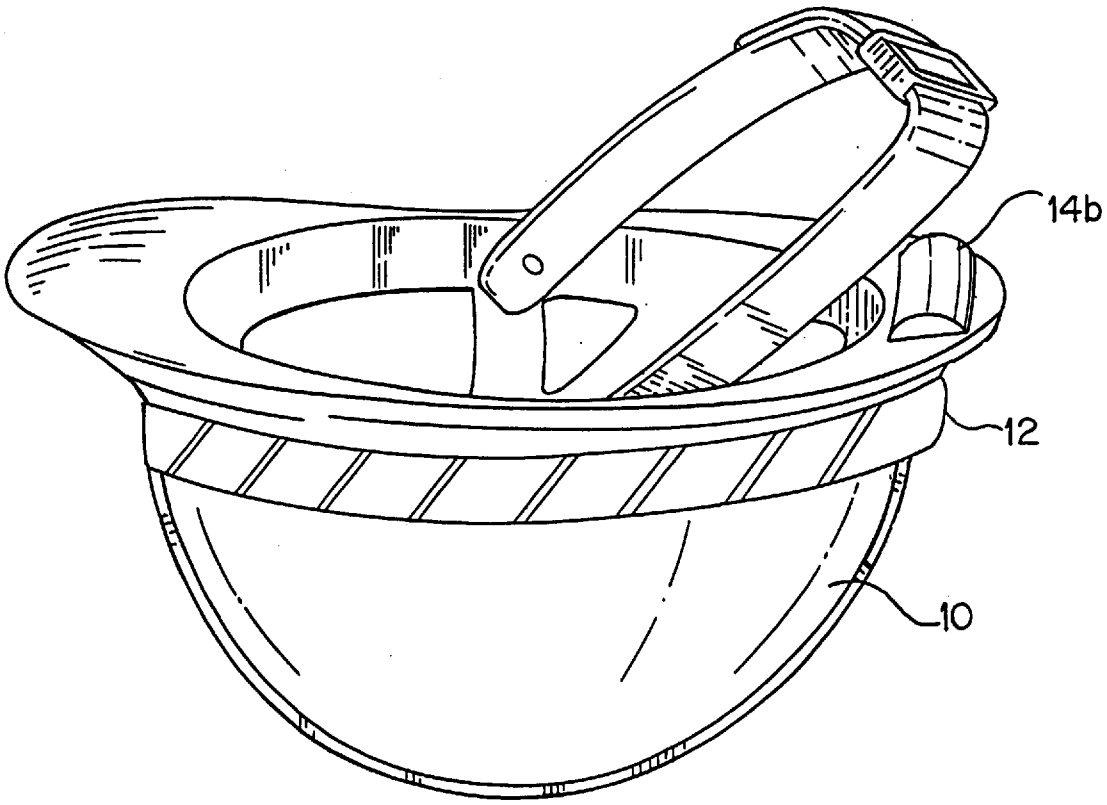
FIG. 3 illustrates a modification of the illuminated protective hat according to the first embodiment.

As yet another example, the power unit portion 14*b* can be formed to extend beneath and protrude from the lower surface of the rim portion of the hard hat, as illustrated in FIG. 3.

The location of the power unit portions arranged on the rim portion of the hard hats may vary about the circumference of the rim portion.

Figure 4:
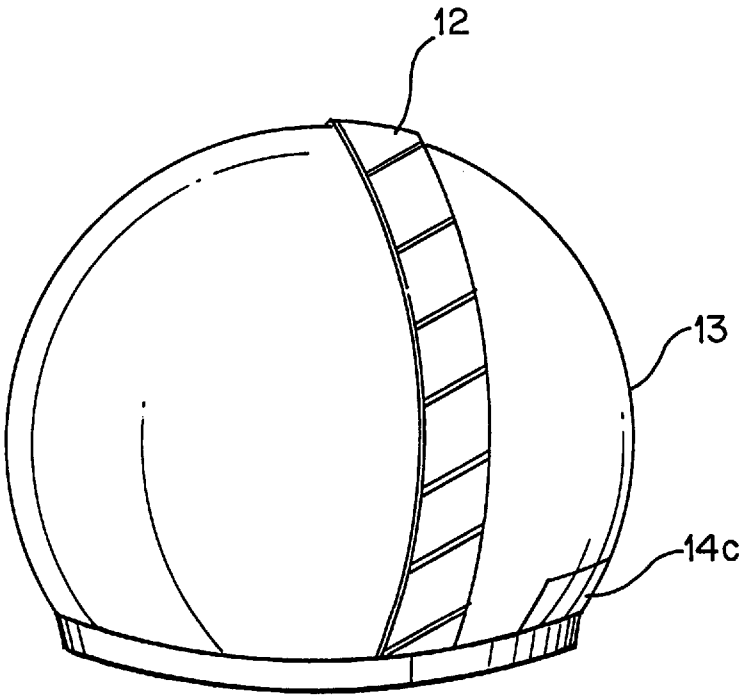
FIG. 4 illustrates an astronaut's helmet including an electroluminescent lamp and power unit portion.

FIG. 4 illustrates an astronaut's helmet 13 which includes at least one electroluminescent lamp 12 and power unit portion 14*c*.

The illuminated hard hat or protective hat according to the present invention may be manufactured as an original unit. In addition, existing protective hats may easily be re-tooled to include the power unit portion discussed above. The manufacturing of hard hats and re-tooling operations may be performed in accordance with known manufacturing techniques.

Figure 5:
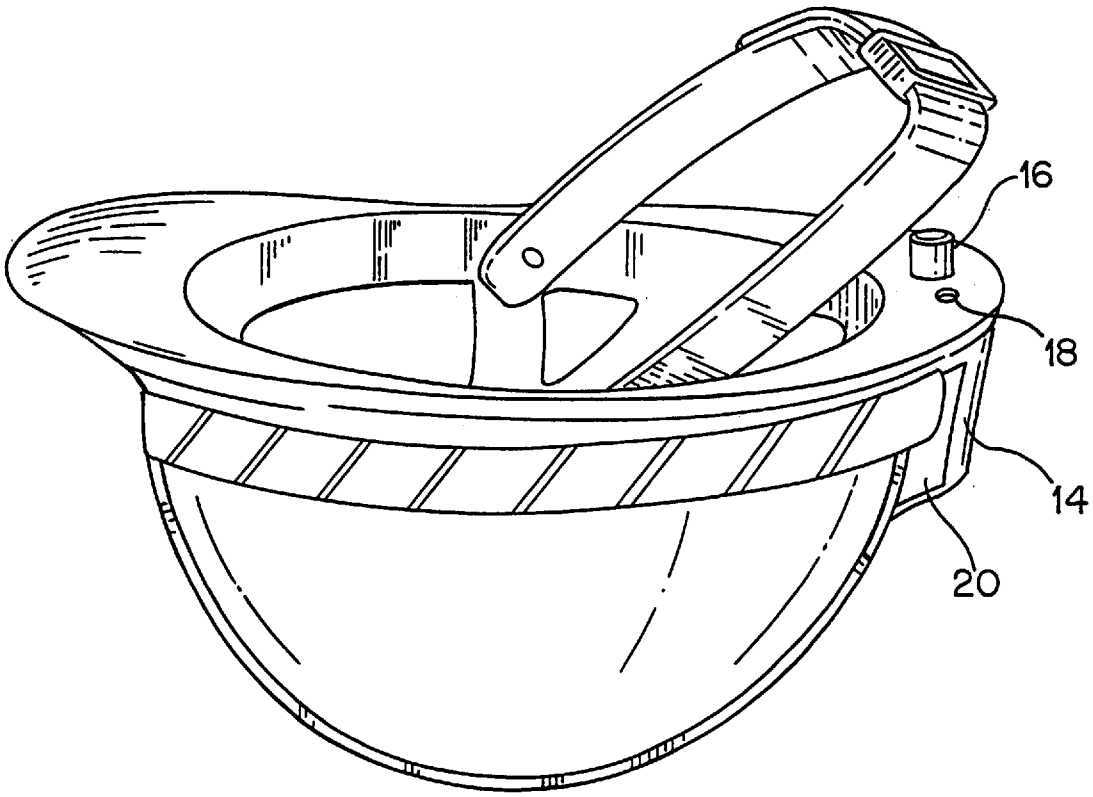
FIGS. 5 illustrates the arrangement of the power unit portion and the electroluminescent lamp on the illuminated protective hat illustrated in FIG. 1.

Referring to FIG. 5, the power unit portion 14, for the hard hat illustrated in FIG. 1, houses a battery 15, which may be a rechargeable battery, and an inverter 17. The battery is connected to the electroluminescent lamp by leads (not shown). In the example illustrated in FIG. 5, the power unit portion 14 includes an ON/OFF switch 16 and recharging female contacts 18 arranged on the bottom of the power unit portion 14 which is on the underside of the hard hat. An access door 20 is provided on the power unit portion 14. In the present example, the access door 20 is arranged on the side of the power unit portion 14. The access door may be secured by any number of known techniques.

The power unit portion in each of the examples illustrated in FIGS. 2–4 is arranged in a manner similar to that set forth above. Therefore, no detailed description of these examples is provided.

Figure 6:
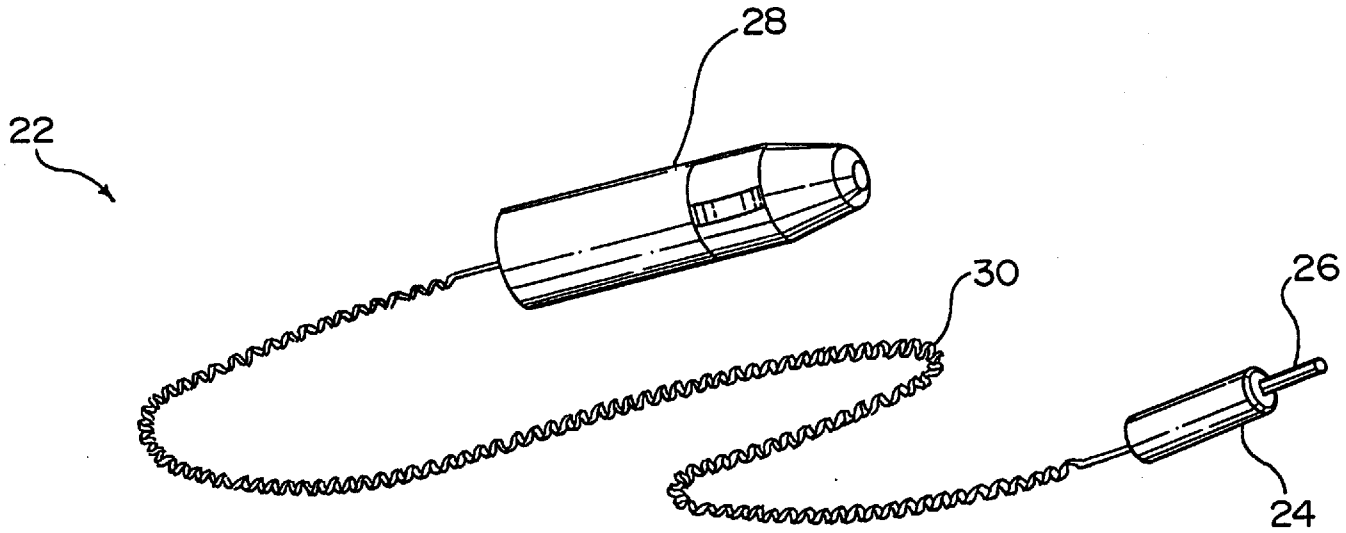
FIG. 6 is an illustration of a recharging unit according to a first embodiment of the present invention.

Referring to FIG. 6, a recharging unit 22 includes a connector 24 having male contacts 26 and a charger section 28 connected to the connector 24 via a coaxial cable 30. In order to recharge the battery 15 in the power unit portion 14, the male contacts 26 are inserted into the recharge female contacts 18 of the power unit portion 14, and the charger section 28 is inserted into the lighter of a vehicle (not shown), such as a truck, so that the electroluminescent lamp illuminating the hard hat is ready for use the following day.

Figure 7:
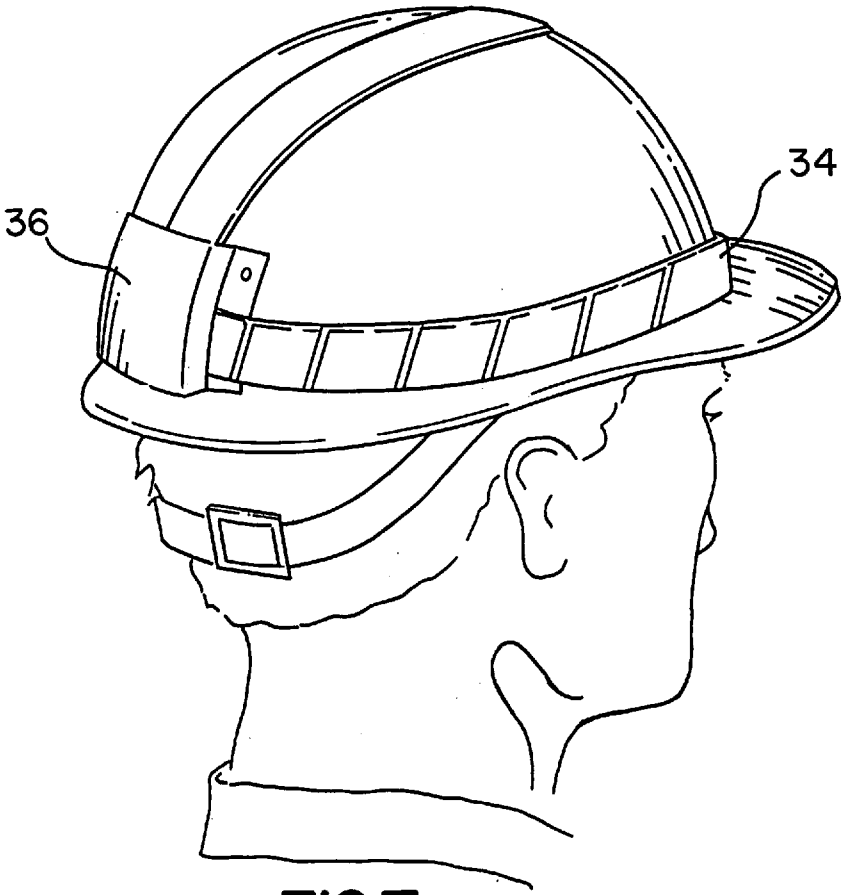
FIG. 7 is a perspective view of a hard hat including a retrofit unit according to a second embodiment of the invention as seen from the side.

A second embodiment of the present invention will be discussed with reference to FIGS. 7–9.

Figure 8:
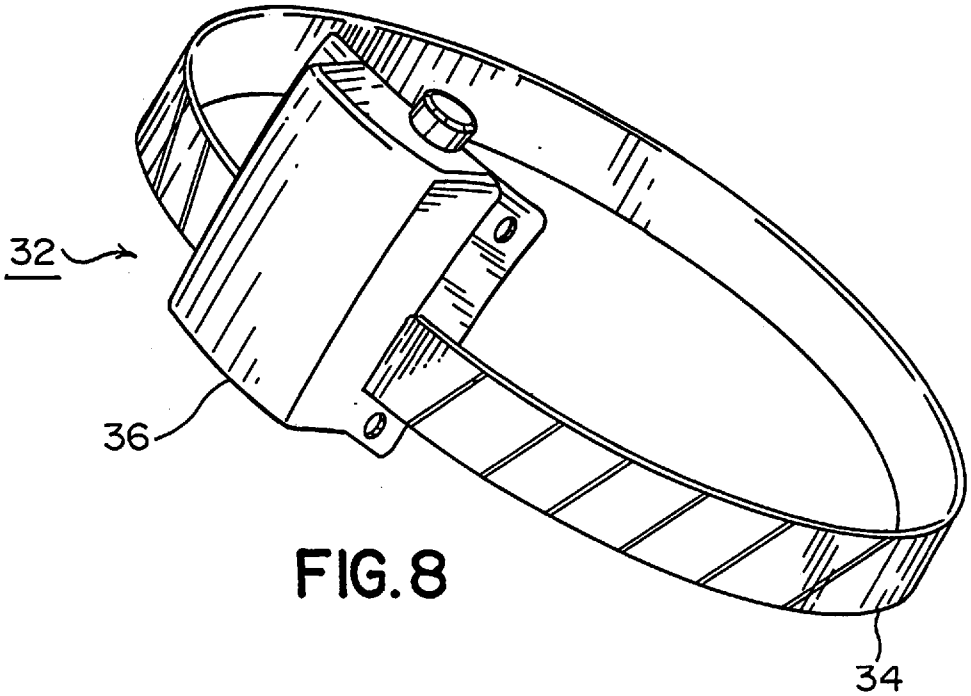
FIG. 8 is an illustration of a retrofit unit according to a second embodiment of the present invention.
Figure 9:
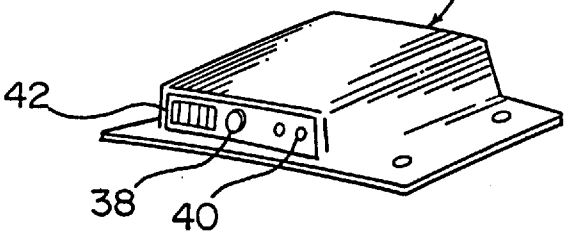
FIG. 9 is an illustration of the power unit according to the second embodiment.

The second embodiment of the invention is directed to a retrofit unit 32 which can be used to adapt existing protective hats to include at least one electroluminescent lamp 34 and power unit 36, as illustrated in FIG. 8. In the example illustrated in FIG. 8, the electroluminescent lamp is in the form of a strip. However, the electroluminescent lamp may have varying shapes. The arrangement of the power unit 36 is illustrated in FIG. 9. The shell of the power unit 36 can be easily formed by any known techniques, such as a vacuum process. The power unit 36 houses the battery 15 and the inverter 17. The power unit 36 includes an ON/OFF switch 38 arranged on one surface of the power unit 36, and recharge female contacts 40 for receiving the male contacts 26 of the recharging unit 22, illustrated in FIG. 6. An access door 42 is also provided on one of the surfaces of the power unit 36. In the example illustrated in FIG. 9, the access door 42 is formed on the surface including the ON/OFF switch 38 and the recharge female contacts 40.

Both the electroluminescent lamp 34 and the power unit 36 of the retrofit unit 32 can either be permanently or temporarily secured to the existing protective hat.

The electroluminescent lamp 34 and the power unit 36 may be permanently fixed to the shell of the protective hat by any number of methods. For example, the electroluminescent lamp 34 and the power unit 36 may be secured to the protective hat by an adhesive. It is preferable to use adhesives for use with polyethylene, such as the "Scotch Grip #4693" adhesive produced by 3M Corporation. In addition, double coated tapes, heated from both sides with a primer, may be used to create a strong bond on polyethylene.

In addition, the power unit may be riveted or screwed into the shell of the protective hat. In the example illustrated in FIG. 7, the power unit 36 is secured to the shell of the hard hat by rivets.

Figure 11A:
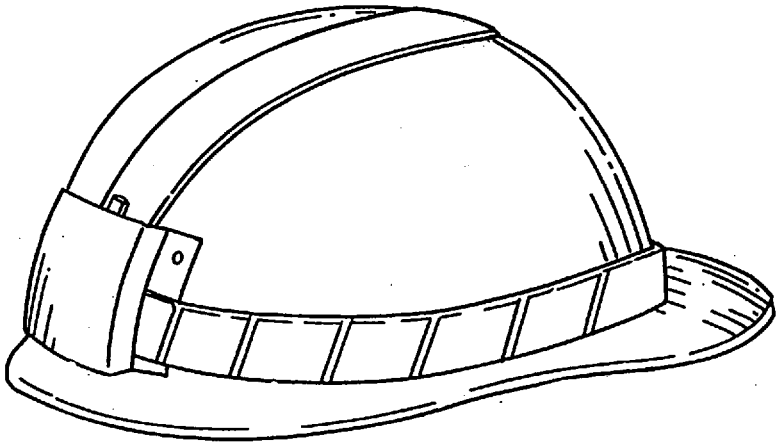
FIGS. 11*a* and 11*b* illustrate a velcro arrangement for the retrofit unit illustrated in FIG. 8.
Figure 11B:
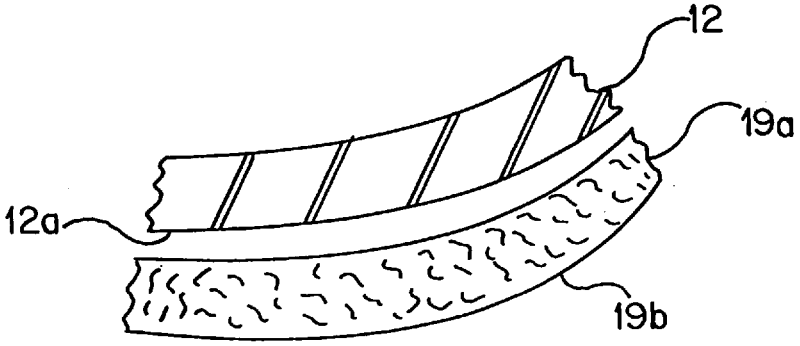

Alternatively, the electroluminescent lamp 34 and the power unit 36 may be temporarily secured to the shell of the protective hat by a velcro arrangement, for example, as shown in FIGS. 11*a* and 11*b*. The velcro arrangement includes a first portion 19*a* adhesively secured to the shell of the protective hat, and a corresponding velcro surface 12*a* secured to a lower surface of the electroluminescent lamp 12. A roll-on adhesive with a solvent to create permanency may be used.

The retrofit unit may also be applied to an illuminated safety sports helmet such as a bicycling helmet. An illuminated safety helmet is disclosed in U.S. Pat. No. 5,327,587, which is herein incorporated by reference.

The illuminated safety helmet discussed in the above-mentioned patent includes at least one electroluminescent lamp permanently adhered to the helmet shell. The retrofit unit set forth hereinabove may be used to retrofit previously manufactured safety helmets to include an electroluminescent lamp and power unit portion. The retrofit unit is secured to the safety helmets in the same manner as noted above with respect to the protective hats.

The illuminated protective hat and the retrofit unit according to the present invention include at least one electroluminescent lamp, which is battery operated so that the individual wearing the protective hat is highly visible from a distance over ¼ mile, and a power unit portion for supplying power to the electroluminescent lamp. The electroluminescent lamp is flexible and light-weight so that the use of the lamp and the power unit do not substantially add to the weight of the protective hat.

In addition, the electroluminescent lamp illumination device for protective hats according to the present invention is extremely thin, durable and would most likely remain operable under adverse circumstances where, a light bulb or a lamp bracket and lamp arrangement, including a filament and wires, would not. For example, should an incident occur whereby the protective hat having only a bulb extension receive an impact, lateral or overhead, the bulb is destroyed. Moreover, the individual would subject to the danger presented by the exposed wires. However, the electroluminescent lamp would be likely continue to operate since there is no filament, wires or glass to break, and since the lamp does not significantly protrude from the surface of the protective hat. Therefore, the use of the electroluminescent lamp contributes to the safety of the working environment.

For example, in forming the protective hats for minors, it is critical to pour epoxy over the elements to conjoin all of the elements, thereby preventing exposure of electrical wires and preventing electrical contact of the exposed wires with conductive objects, so as to conform to ANSI standards for head protection.

Finally, the electroluminescent lamp provides even illumination which renders an individual visible to provide a safe working environment, but which does not interfere with the illumination of the work area.

The illuminated protective hat and the retrofit unit can be easily produced at minimal cost.

The electroluminescent illuminated protective hat according to the present invention provides an economical, safe and effective option for saving lives by ensuring the safety of workers by improving the visibility of the workers.

While the invention has been described in detail and with reference to specific embodiments, it will be apparent to one skilled in the art that various modifications can be made without departing from the spirit and scope of the invention.

What is claimed is:

1. An illuminated protective hat comprising:

a protective hat shell having a power unit portion formed thereon; and at least one electroluminescent lamp secured to said protective hat shell;

said power unit portion being provided to supply power to said at least one electroluminescent lamp;

wherein said power unit portion comprises contacts for connection to a recharging unit.

2. The illuminated protective hat as defined in claim 1, wherein said power unit portion of said protective hat shell bulges outward.

3. The illuminated protective hat as defined in claim 1, wherein said power unit portion comprises:

an access means for providing access to an interior of said power unit; and an ON/OFF switch.

4. The illuminated protective hat as defined in claim 1, wherein illumination generated by said electroluminescent lamp is intermittent.

5. The illuminated protective hat as defined in claim 1, wherein said power unit portion houses a battery, and wherein said power unit portion includes an access door and an ON/OFF switch for controlling operation of said battery.

6. The illuminated protective hat as defined in claim 5, wherein said battery is a rechargeable battery.

7. The illuminated protective hat as defined in claim 5, wherein said power unit portion further houses an inverter, connected to said battery, for converting a DC signal from said battery to an AC signal.

8. The illuminated protective hat as defined in claim 6, wherein said contacts are female contacts for receiving male contacts of said recharging unit for recharging said rechargeable battery.

9. A retrofit unit for retrofitting a protective hat to include an illumination device, said retrofit unit comprising:

at least one electroluminescent lamp;

a power unit, connected to said at least one electroluminescent lamp via unexposed leads, for supplying power to said at least one electroluminescent lamp, wherein said at least one electroluminescent lamp is arranged to begin at and extend from said power unit to facilitate use of said unexposed leads;

first securing means for securing said at least one electroluminescent lamp to a shell of said protective hat; and second securing means for securing said power unit to said protective hat;

wherein said first securing means and said second securing means is a permanent securing means.

10. The retrofit unit as defined in claim 9, wherein said power unit comprises:

access means for providing access to an interior of said power unit;

an ON/OFF switch; and recharging contacts for connection to a recharging unit.

11. The retrofit unit as defined in claim 10, wherein at least one of said first securing means and said second securing means comprises an adhesive.

12. The retrofit unit as defined in claim 10, wherein at least one of said second securing means comprises a Velcro arrangement.

13. The retrofit unit as defined in claim 10, wherein said second securing means comprises rivets.

14. The retrofit unit as defined in claim 10, wherein said power unit houses a battery which is accessed via said access means.

15. The retrofit unit as defined in claim 14, wherein said battery is a rechargeable battery.

16. The retrofit unit as defined in claim 14, wherein said power unit further houses an inverter, connected to said battery, for converting a DC signal from said battery to an AC signal.

17. The retrofit unit as defined in claim 16, wherein illumination generated by said electroluminescent lamp is intermittent.

18. An illuminated protective hat comprising:

a protective hat shell;

a power unit which is integrally formed with said protective hat shell and which protrudes outward from said protective hat shell; and at least one electroluminescent lamp secured to said protective hat shell;

said power unit being provided to supply power to said at least one electroluminescent lamp.

19. The illuminated protective hat as defined in claim 18, wherein said power unit comprises a battery and an inverter for converting a DC signal from said battery to an AC signal.

20. The illuminated protective hat as defined in claim 19, wherein access means for providing access to an interior of said power unit is provided in said power unit.

21. The illuminated protective hat as defined in claim 20, wherein said battery is a rechargeable battery.

22. The illuminated protective hat as defined in claim 21, wherein said power unit comprises contacts for connection to a recharging unit.

23. The illuminated protective hat as defined in claim 18, wherein said protective hat shell comprises a rim portion.

24. The illuminated protective hat as defined in claim 23, wherein an upper surface of said rim portion forms one wall of said power unit.

25. The illuminated protective hat as defined in claim 24, wherein said rim portion forming said one wall of said power unit comprises access means for providing access to an interior of said power unit.

26. The illuminated protective hat as defined in claim 25, wherein said rim portion forming said one wall of said power unit comprises a control switch.

27. The illuminated protective hat as defined in claim 23, wherein said power unit is integrally formed on an upper side of said rim portion of said protective hat shell.

28. The illuminated protective hat as defined in claim 23, wherein said power unit of said protective hat shell is integrally formed on an underside of said rim portion of said protective hat shell.

29. The illuminated protective hat as defined in claim 19, wherein access means for providing access to an interior of said power unit is provided in said protective hat shell.

30. An illuminated protective hat comprising:

a protective hat shell having a rim portion;

a power unit which is secured to an underside surface of said rim portion, and protruding outward from said rim portion; and at least one electroluminescent lamp secured to said protective hat shell;

said power unit being provided to supply power to said at least one electroluminescent lamp.

31. The illuminated protective hat as defined in claim 30, wherein said power unit houses a battery and an inverter for converting a DC signal from said battery to an AC signal.

32. The illuminated protective hat as defined in claim 31, wherein said power unit comprises access means for providing access to an interior of said power unit.

33. The illuminated protective hat as defined in claim 32, further comprising a control switch.

34. The illuminated protective hat as defined in claim 30, wherein said power unit comprises contacts for connection to a recharging unit.

35. The illuminated protective hat as defined in claim 31, wherein said upper side surface of said rim comprises access means for providing access to an interior of said power unit.

36. The illuminated protective hat as defined in claim 1, wherein said underside surface of said rim comprises access means for providing access to an interior of said power unit.

37. A retrofit unit for retrofitting a protective hat to include an illumination device, said retrofit unit comprising:

at least one electroluminescent lamp;

a power unit connected to said at least one electroluminescent lamp via unexposed leads;

first securing means, provided on a surface of said power unit to be secured to said protective hat, for securing said power unit to said protective hat; and second securing means, provided on a surface of said at least one electroluminescent lamp to be secured to said protective hat, for securing said at least one electroluminescent lamp to said protective hat;

wherein said first securing means and said second securing means comprise a permanent securing means.

38. The retrofit unit as defined in claim 37, wherein said power unit comprises:

access means for providing access to an interior of said power unit;

an ON/OFF switch; and recharging contacts for connection to a recharging unit.

39. The retrofit unit as defined in claim 37, wherein at least one of said first securing means and said second securing means comprises an adhesive.

40. The retrofit unit as defined in claim 37, wherein at least one of said first securing means and said second securing means comprises a Velcro arrangement.

41. The retrofit unit as defined in claim 37, wherein said first securing means comprises rivets.

42. The retrofit unit as defined in claim 38, wherein said power unit houses a battery which is accessed via said access means.

43. The retrofit unit as defined in claim 42, wherein said battery is a rechargeable battery.

44. The retrofit unit as defined in claim 42, wherein said power unit further houses an inverter, connected to said battery, for converting a DC signal from said battery to an AC signal.

45. The illuminated protective hat as defined in claim 24, wherein said power unit comprises access means for providing access to an interior of said power unit.

46. A retrofit unit for retrofitting a protective hat to include an illumination device, said retrofit unit comprising:

at least one electroluminescent lamp;

a power unit, connected to said at least one electroluminescent lamp via unexposed leads, for supplying power to said at least one electroluminescent lamp, wherein said at least one electroluminescent lamp is arranged to begin at and extend from said power unit to facilitate use of said unexposed leads;

first securing means for securing said at least one electroluminescent lamp to a shell of said protective hat; and second securing means for securing said power unit to said protective hat;

wherein said first securing means and said second securing means is a temporary securing means.

47. An illuminated protective hat comprising:

a protective hat shell having a rim portion;

a power unit which is secured to an upper side surface of said rim portion, and protruding outward from said rim portion; and at least one electroluminescent lamp secured to said protective hat shell;

said power unit being provided to supply power to said at least one electroluminescent lamp.

48. A retrofit unit for retrofitting a protective hat to include an illumination device, said retrofit unit comprising:

at least one electroluminescent lamp;

a power unit connected to said at least one electroluminescent lamp via unexposed leads;

first securing means, provided on a surface of said power unit to be secured to said protective hat, for securing said power unit to said protective hat; and second securing means, provided on a surface of said at least one electroluminescent lamp to be secured to said protective hat, for securing said at least one electroluminescent lamp to said protective hat;

wherein said first securing means and said second securing means comprise a temporary securing means.

49. An illuminated helmet for astronauts comprising:

a protective shell having a power unit portion integrally formed therewith;

at least one electroluminescent lamp secured to said protective shell and connected to said power unit portion via unexposed leads;

a control switch arranged at one of a position proximate to said power unit portion and on said power unit; and access means, arranged in one of said protective shell and said power unit portion, for providing access to an interior of said power unit portion;

said power unit portion being provided to supply power to said least one electroluminescent lamp.

* * * * *